US005732472A

United States Patent [19]

Praye

[11] Patent Number: 5,732,472

[45] Date of Patent: Mar. 31, 1998

[54] GYPSUM WALLBOARD SCORING TOOL

[76] Inventor: Brian Praye, 173 Ski Hill Dr., Leavenworth, Wash. 98826

[21] Appl. No.: 551,945

[22] Filed: Nov. 2, 1995

[51] Int. Cl.[6] ..... B43L 13/00; B26B 29/06

[52] U.S. Cl. ..... 33/42; 33/32.2; 30/293

[58] Field of Search ..... 33/42, 32.1, 32.2, 33/32.3, 43, 479; 30/293, 294, 289, 286; 83/454, 455, 578, 581, 614, 745, 563, 564, 640, 642, 644, 821, 829; 7/163; 1/164

[56] References Cited

U.S. PATENT DOCUMENTS

| | | | |
|---|---|---|---|
| 1,100,878 | 6/1914 | Higgins et al. | 33/32.2 |
| 3,439,426 | 4/1969 | Wilson | 33/32.2 |
| 4,903,409 | 2/1990 | Kaplan et al. | 33/42 |
| 4,949,462 | 8/1990 | Spencer | 33/42 |
| 4,956,919 | 9/1990 | Granger | 33/42 |
| 5,035,061 | 7/1991 | Bradbury et al. | 33/42 |
| 5,309,642 | 5/1994 | McGinnis | 33/42 |
| 5,406,711 | 4/1995 | Graham | 33/42 |
| 5,471,753 | 12/1995 | Rodrigues | 33/42 |

*Primary Examiner*—Christopher W. Fulton
*Attorney, Agent, or Firm*—David L. Tingey

[57] ABSTRACT

An edge guided tool for scoring flat panels comprises a cutter assembly sliding on a track mounted on a conventional T-square vertical rail. A cutting tool body supporting a cutting plate over a panel to be cut is slideably mounted in the track on a resilient spring plate such that when the cutting blade is urged down toward the panel on the bending spring plate, the slide is urged against track sides to prevent further sliding, locking the slide and the blade in an alignment position. With the blade locked parallel to a T-square fence rail, as the T-square is moved with its fence rail abutted along a panel edge as a guide while the cutting blade is urged into the panel, the panel is scored along its length parallel to its length.

4 Claims, 3 Drawing Sheets

GYPSUM WALLBOARD SCORING TOOL

BACKGROUND

1. Field of Invention

This invention relates to cutting or scoring tools, specifically to an edge-guided scoring tool for gypsum wallboard panels.

2. Description of Prior Art

Gypsum Wall Board ("GWB") is the name given to a panel with a gypsum core sandwiched between paper surfaces bonded thereto and wrapped around the panel edges at its edges. These panels form the inside walls and ceilings of most commercial and residential structures. The panels range in thickness from ¼" to 1 " with ½" and ⅝" being the most common. They come in standard widths of 48" and 54", and in lengths from 8 to 16 feet.

The physical properties of a GWB panel allow cutting by merely scoring the panel through the paper surface with a standard utility knife. After the panel is scored, it is then snapped or broken away from the scored line, but remains attached by the paper on the opposite side of the panel which acts as a hinge. The top piece of the panel is then bent back at an angle of a sufficient degree to form a kind of valley on the backside of the panel at the intersection of the two pieces. The paper which forms the hinge at this intersection is then cut with the utility blade to complete the separation of those pieces.

Since it is essential to keep the cuts straight, some type of guide or straight edge is needed. GWB installers typically use a T-square to make all end cuts, which cuts are perpendicular to the long edge of the GWB panel and therefore have a maximum length of 48 or 54 inches.

A T-square is a general name for a device composed of two flat, thin rails with one rail, called the fence rail, being attached orthogonally to the bottom of one end of the other rail, referred to as the vertical rail. When the bottom surface of the vertical rail is placed on a straight edge of a flat object and the fence rail is in abutted against an edge of that object, the vertical rail will extend across that surface perpendicularly.

They are currently being commercially manufactured in a standard design which works quite well for GWB installers and carpenters in building construction. The standard design is a vertical rail, approximately 125 cm long, 5 cm wide, and 0.5 cm thick with inch marks on a first, or front, edge starting from its top and ending at its bottom. A second, or rear, edge opposite the front edge has inch marks in reversed direction, from bottom to top. The fence rail is approx. 3.75 cm wide, 0.5 cm thick, and 56 cm long.

These standard T-squares work quite well for end cuts. However, they are impractical for ripping (cutting parallel to the long edge of the GWB panel) because of the limited length of the vertical rail being less than that of the panel. As a result, professional wallboard installers have developed other techniques for ripping.

In a technique using a chalkline, a mark is made at each end of the panel. A chalkline is then used to mark a line between these marks over the length of the panel, followed by freehand scoring along the line with a utility knife. This is not only a time consuming process but is also potentially inaccurate due to the difficulty of maintaining a straight line without aid of a straightedge.

A second technique uses a tape measure and utility knife. A mark is made at the right-hand edge of the panel. The tape is then pulled out and the angled endpiece of the tape is pinched together with the protruding end of the utility knife blade by the thumb and the inside of the forefinger of the right hand. The blade and tape end are then set on the mark and held there by the right hand while the left hand which is holding the body of the tape measure is drawn up toward the edge of the panel at a perpendicular angle until it just clears the edge. The thumb and forefinger of the left hand then pinch the tape in a loose grip and are slid back down the tape towards the panel edge until the left forefinger is tight against that edge. The grip by the left fingers is then tightened so the distance between the right and left hands remains constant and the left forefinger forms a stop. With the tape stretched tight and at a perpendicular angle to the panel edge both hands are then drawn the entire length of the panel by walking backwards or sideways, with the left forefinger sliding along the top edge while the right hand presses and holds the end of the knife blade into the surface of the GWB at a sufficient depth to score a cut through the paper surface and slightly into the core.

While this second method is the one used by virtually all professional wallboard installers it suffers from a number of disadvantages. The ripping process described above is a difficult skill to learn requiring a substantial amount of practice over what can amount to a considerable length of time. Even experienced journeymen in the field often have difficulty achieving accurate results because the act of drawing both hands the length of the panel at the exact rate while maintaining the exact distance between the blade and the stop formed by the left hand while walking backwards without tripping or slipping is inherently difficult no matter how skilled one is.

Another difficult and often painful aspect of this process is that the left forefinger experiences a great deal of friction when drawn down the panel edge which after repeated usage tends to wear the skin away.

Also, The edges of GWB panels often suffer various degrees of damage during transport, often having pieces of the panel broken off along the edge in sizes up to 6 or 8 inches in length. Since the stop formed by the left hand uses this edge as a guide to maintain an accurate line during the ripping process, the absence of any significant portion of that edge will eliminate the guide and will significantly and adversely affect the accuracy of the cut.

When making rips of a small width of ½to 1 inch, another problem arises because the tape is too stiff to permit it to have a half twist required between the right and left fingers as they may only be a half an inch apart. This makes it very difficult to keep the cutting blade aligned in the proper position and the left finger solidly on the guide edge of the panel. And when the width of the rip and the corresponding distance between the right and left hands becomes more than about 24", it becomes more difficult to maintain an equal distance between the right and left hands and a perpendicular angle to the panel edge.

The constant twisting, dragging, stretching and general usage of the tape measure during the ripping process also is very hard on the tape and significantly reduces its life span.

When the GWB panels are delivered to a jobsite, they are distributed or stocked in stacks of no more than about 40 or 50 pieces which are then leaned up against walls throughout the building site, or they remain in stacks on the floor. When GWB panels are flat stocked on the floor the ripping process becomes more difficult, especially on wide cuts, because one's feet and center of gravity must remain along the edge of the stack while reaching out into the stack with the cutting blade and supplying sufficient pressure to score the panel surface.

A serious safety hazard is created by the act of pinching the exposed end of the utility knife blade between the fingers of the right hand, as these blades are extremely sharp. With the fingers in such close proximity to an unprotected cutting edge, the slightest slip or fall can easily result in serious personal injury.

Accordingly, several objects and advantages of my invention are as follows. A first object is to provide an accurate edge-guided tool that will cut or score GWB panels through its entire length and parallel to its long edge—the process known as 'ripping.' Another object is to provide a ripping tool which is easy to use and does not require a lengthy learning process so a novice or apprentice could immediately make rips as accurately as an experienced journeyman applicator. A further object is to provide a tool which is physically easy to use by enabling the user to move in a forward direction while guiding the tool the length of the work. A still further object is to provide a tool which eliminates the need for the installer to use his finger to form a stop on a tape measure, sliding it along the edge of the work, and the subsequent loss of skin after repeated use. An additional object is to provide a tool that will maintain accuracy during ripping on a panel having a significant amount of damage to its guiding edge by spanning the damaged or missing portion of that edge. Yet another object is to provide a tool which performs the ripping process equally well on both vertical and horizontal stacks of panels. Another important object is to provide a tool which eliminates the potential safety hazard created by the need to pinch and hold the exposed and very sharp end of a utility knife blade during the ripping process. A final object is to provide a ripping tool easy and inexpensive to manufacture with few parts designed so that the parts can be either manufactured and assembled as a stand-alone tool or merely added onto an existing commercially manufactured T-square, thereby increasing the usage and value of a tool that professional installers already own and use. Still further objects and advantages will become apparent from a consideration of the ensuing description and drawings.

SUMMARY OF THE INVENTION

The stated objects of the invention are achieved in an edge-guided scoring tool for Gypsum wallboard comprising a cutter assembly sliding on a track. The track is mounted on the vertical rail of a conventional T-square.

The cutter assembly comprises a cutter body supporting a cutting blade in a recess angled at approximately 35 degrees from the plane of the T-square vertical rail. The cutter body is mounted on a resilient spring plate with the cutting blade disposed slightly above said plane and orthogonal to the vertical rail such that when the cutter body is urged downward on the spring plate, the blade lowers below said plane into a panel on which the T-square may be resting. Thus, when the T-square is moved along the panel with a T-square fence rail abutted against a panel edge, the blade scores the panel in a straight line parallel to the panel edge.

The cutter assembly includes a slide mounted in a track longitudinal on the T-square vertical rail. The track comprises an inclined side under which a side of the slide fits. The slide is locked in a selective longitudinal track position by urging the cutter body down, causing the spring plate to bend and push the slide immovably against the track included plane with increased friction between the slide and inclined plane preventing movement in the track.

DETAILED DESCRIPTION OF THE PREFERRED EMBODIMENT

Figure 1:
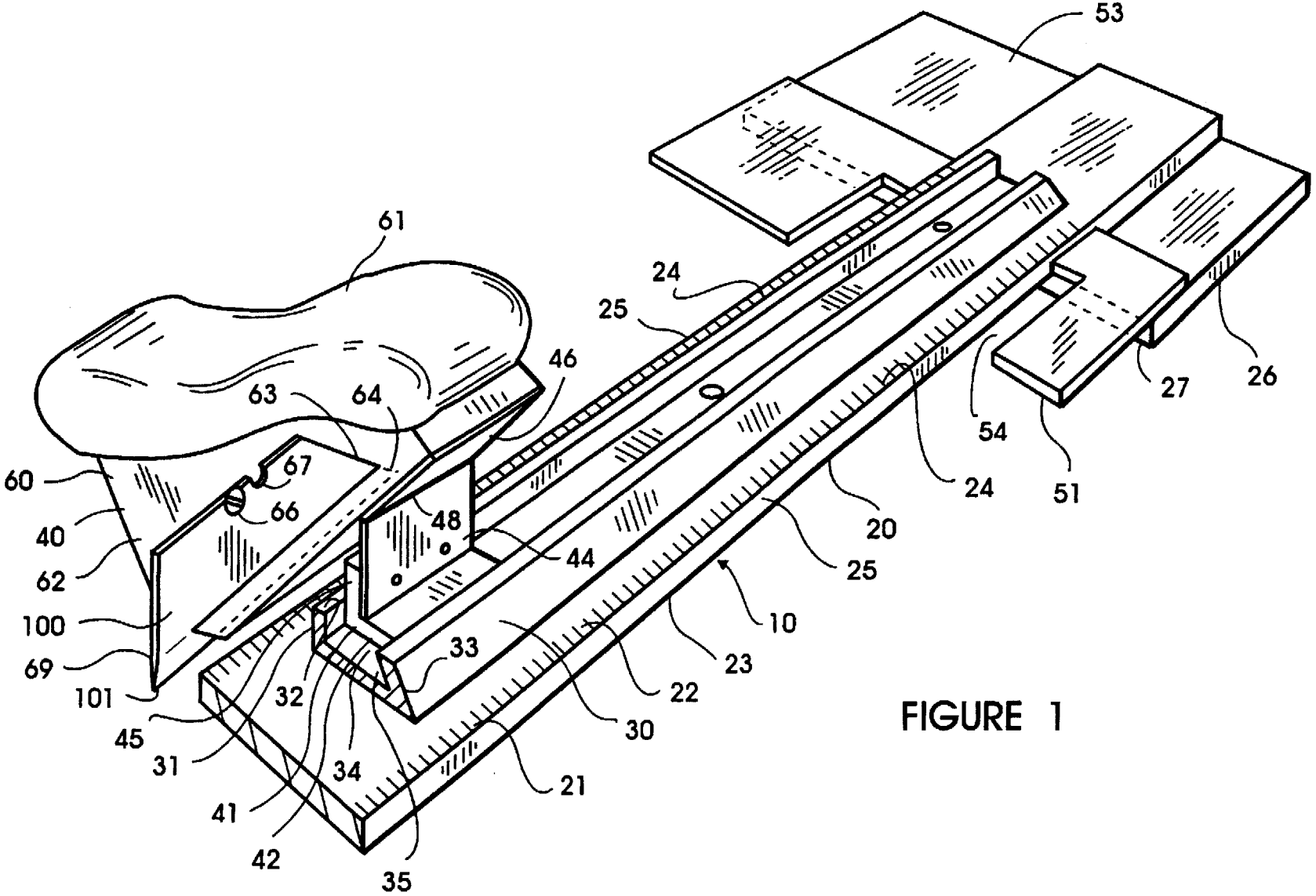
FIG. 1 shows a T-square with cutter track and stabilizing flanges with a cutter assembly engaged in a track.
Figure 2:
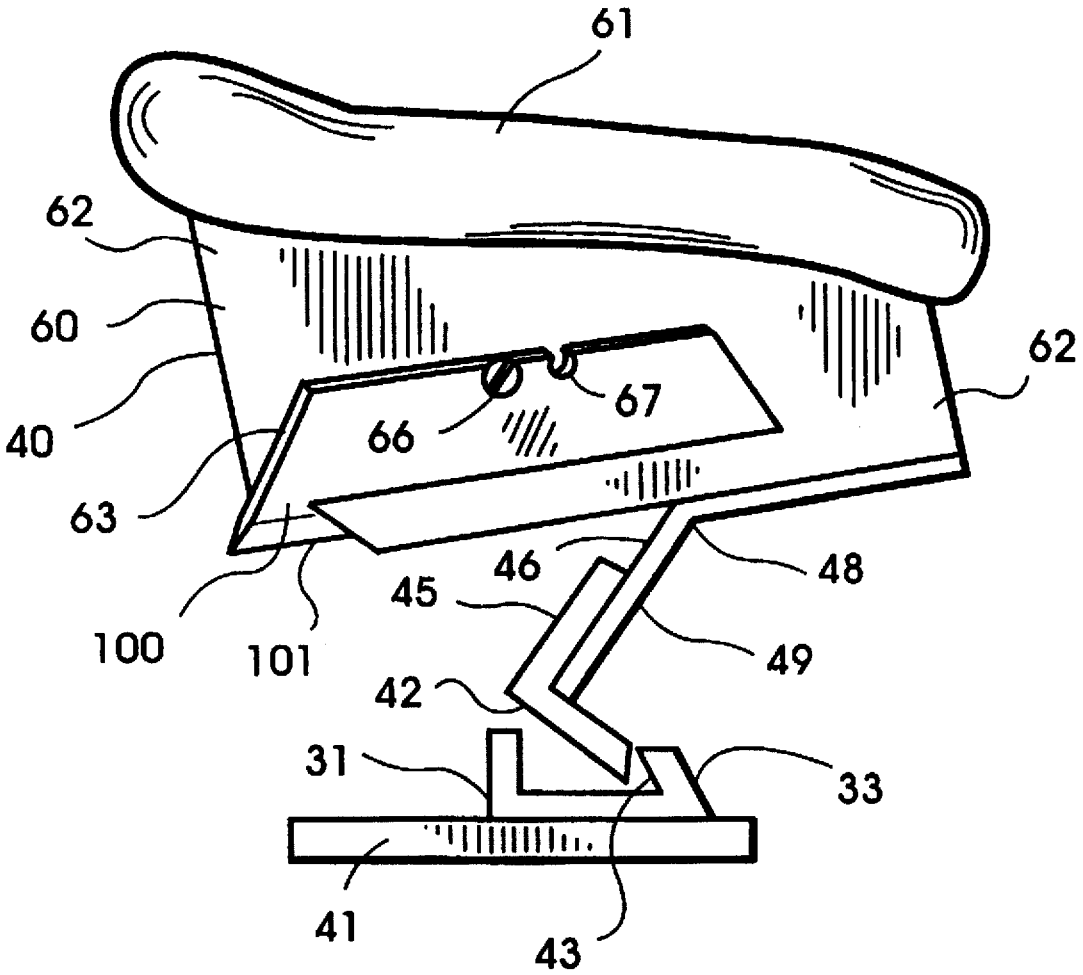
FIG. 2 is a side view showing a slide partially inserted in a track.
Figure 3:
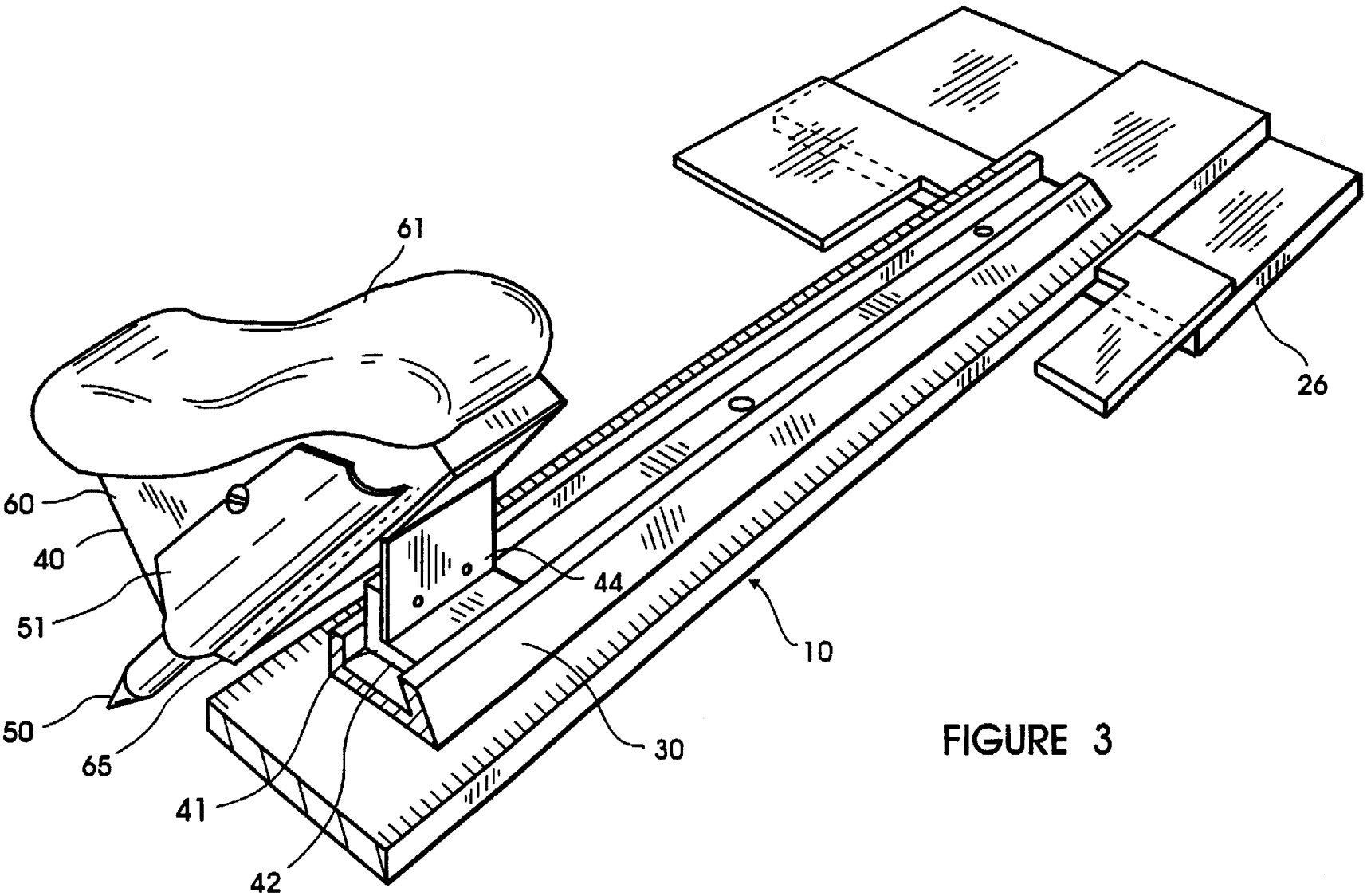
FIG. 3 is a perspective view of a retaining plate securing a marker to the cutter body in lieu of a cutting blade.

As shown in the figures, the cutting tool 10 of the present invention comprises T-square 20, a track 30 secured to the T-square, and a cutter assembly 40 slideably mounted in the track 30.

The T-square 20 includes a vertical rail 21 with an upper and a lower surface 22 and 23 with measurement marks 24 on its outside edges 25. It also includes a fence rail 26 with a straight edge 27 attached orthogonally to the T-square vertical rail under the vertical rail lower surface 23 at a vertical rail first end, the straight edge toward the vertical rail distal end. The track 30, secured to the vertical rail upper surface 22 and running central on its length so as not to cover the measurement marks 24, comprises a vertical first side 31 with a top 32, a second side 33 inclined toward the first side 31 at an angle to form a track channel 34, the first and second sides being spaced apart by a race 35 on which the cutter assembly 40 slides while being retained in the track 30 by the inclined second side 33.

To aid in locating and aligning the T-square 20 on a work surface, the fence rail 26 has a flange 51 attached to the top surface 53 of the fence rail 26 over the straight edge 27 as an extension of the vertical rail lower surface 23 and in a common plane therewith. The flanges 51 have a gap 54 adjacent the vertical rail 21 to allow a utility knife to score a panel near the fence rail 26.

The cutter assembly 40 includes a slide 41 comprising a base 42 slideably fit in the track 30 on the race 35. A base cuneiform first side 43 is disposed opposite the track second side 33 and angled to the match track channel 34. The slide 41 further includes a slide mounting plate 44 on a base second side 45 and disposed opposite the track first side 31 and extending vertically above its top 32. A resilient spring plate 46 extends vertically from the slide mounting plate 44. The slide 41 is sized to loosely fit in the track 30 to the extent that it can be installed by inserting the slide base first side 43 under the inclined track second side 33 and then pushing the slide mounting plate down into the track opposite the track first side 31.

The cutter assembly 40 further comprises a cutter body 60, with a top formed into a handle 61 for gripping, typically constructed of a hard plastic such as nylon or acetal. The slide mounting plate 44 includes a bend 48 on its distal end 49 forming an area of flexure for relative movement of the cutter body 60 on the slide 41.

A cutter body first side 62 orthogonal to the vertical rail 24 and parallel to the fence rail 26 has a blade recess 63 with a bottom 64 and a depth sized to accept a standard utility knife blade 100. Blade recess bottom 64 has an upwardly directed channel 65 to receive a cutting edge 101 of the blade 100, and oriented so that a blade secured therein presents its cutting edge 101 at an acute angle. The acute angle may be approximately 35 degrees to the vertical rail lower surface 23 as it rests on a work surface to facilitate cutting action of the blade. The blade 100 is secured by a blade set screw 66 passing through a hole 67 in the blade 100 and into a matching threaded hole (not shown) in the cutter body 60 with a blade cutting edge extended portion 69 slightly above and close to the vertical rail lower surface 23 when the cutter assembly 40 is engaged in the track 30.

It is clear that instead of a utility knife blade, the cutter body can be adapted to hold a marker 50 so that the cutter assembly 40 marks a panel instead of cuts it. Thus, the assembly further comprises a marker retaining plate 51 with a set screw hole. The retaining plate is adapted to fit in the recess channel 65, secured to the cutter body first side 62 at its blade recess 63 with the blade set screw 66 passing through set screw hole 67 and into the matching threaded hole in the cutter body 60. In use, a marker 50, such as a pencil or scribe, is inserted between the recess 63 and the retaining plate 51 directed downward as the cutting blade 100 and secured in place as the set screw 66 tightens the retaining plate 51 to the cutter body 60.

OPERATION

The method of operation of the cutting tool 10 is begun by making a small mark at one end of a panel at a desired panel width to be cut at a mark. The cutting tool 10 is then placed on the panel at the end that was marked with the fence rail straight edge 27 abutting the edge of the panel and the vertical rail 21 extending across the surface of the panel at a 90 degree angle to both the fence rail 26 and the edge of the panel.

Next, the cutter assembly 40 is installed in the track 30 and slid to alignment of the blade 100 with the small mark 103. The cutter body 60 is then urged toward the panel 102, bending the cutter assembly 40 on the spring plate 46, allowing the blade 100 to be lowered below the plane of the surface of the panel at the small mark 103. When the blade 100 is correctly aligned, the scoring or cutting process is accomplished by pushing the cutting tool 10 the length of the panel while maintaining the fence rail 26 abutted against the edge of the panel.

As the cutter assembly is urged downward toward the panel, the slide mounting plate 44 slightly pivots on the track first side 31 at its top 32, wedging the cuneiform base first side 43 into the track channel 34 of the inclined track second side 33, preventing the slide from further sliding. Thus, the blade 100 does not need to be maintained in alignment as the cutting tool 10 is pushed on the panel as long as the cutter assembly is bent downward on the spring plate 46, which is required for scoring the panel, anyway, so alignment is inherently maintained.

One skilled in the art will recognize the advantages taught by this invention and illustrated by the preferred embodiment presented. The specification and drawings are not intended to represent an exhaustive description of the invention. For example, the handle portion may be of any shape and size to provide comfort for the user; the blade may be of any size and shape to adequately cut or score the desired material; the track size and shape may be altered to allow a different size cutter assembly and could be provided with a series of equally spaced fingers and notches or other method of positive stops at any desired increments; and the track could be provided with measuring marks to line up with a corresponding mark on the clip or cutter assembly to aid in determining cutting distance. Obvious applications and extensions of the invention are intended to be within the spirit and scope of this invention.

Having described the invention, what is claim is:

1. A cutting tool for scoring wallboard comprising a T-square having a vertical rail with an upper and a lower surface and a fence rail secured orthogonally to the T-square vertical rail at a vertical rail first end, a cutting tool body mounted to the T-square vertical rail and comprising a cutting blade with a cutting edge, the blade secured to the cutting tool body and disposed perpendicular to the vertical rail, parallel to the T-square fence rail with the cutting edge extending below the vertical rail lower surface, a track mounted on the vertical rail perpendicular to the fence rail and including an inclined side angled toward the slide to form a channel, a slide on the cutting body sized to fit slideably in the track and including a cuneiform side matching the track channel, means for wedging the slide cuneiform side into the track channel such that sliding of the slide in the track is prevented until the cutting body is released upward on the spring plate.

2. The cutting tool of claim 1 in which the means for wedging the slide cuneiform side into the track channel comprises a resilient spring plate on which the cutter body is mounted which spring plate is secured to secured to the T-square such that when the cutter body is urged downward toward the panel surface, the spring plate bends with the cutting edge extending below the vertical rail lower surface, and the slide cuneiform side is wedged into the track channel.

3. The method of scoring wallboard with a cutting tool attached to a T-square, the T-square including a vertical rail and a fence rail attached orthogonal thereto with a straight edge toward a vertical rail distal end, comprising the following steps:

a. making a small mark on a wallboard panel surface at a desired panel width to be cut at the mark;

b. placing the T-square on the panel at the end that was marked with the fence rail straight edge abutting the edge of the panel and the vertical rail extending across the surface of the panel;

c. securing a cutting tool with a cutting blade on the T-square vertical rail with the cutting blade perpendicular to the vertical rail and parallel to the fence rail straight edge by i. mounting the cutting blade on a slide which is slideably mounted on a track on the vertical rail and said cutting tool attached to the slide through a resilient spring plate between the tool and the slide, which track is orthogonal to the fence rail straight edge and has an inclined side to form a channel in which the slide slides on the track, the slide having a cuneiform side matching the track channel, ii. sliding the slide on the track to a position in which the cutting blade is aligned with the small mark on the panel surface;

iii. wedging the slide cuneiform side into the track channel by urging the cutter tool downward toward the panel surface, in so doing bending the spring plate, the bending spring plate urging the slide firmly into the track channel;

e. urging the cutting blade below the panel surface at the small mark;

f. scoring the panel surface by pushing the T-square and cutting tool on panel surface while maintaining the fence rail abutted against the edge of the panel.

4. The method of claim 3 wherein step "c" further comprises, for a track having an inwardly-inclined first side and an upwardly-extending second side separated by a race on which the slide runs, the slide having a member upwardly-extending from the slide next to and extending beyond the track second side, the step of locking the slide in the track by urging the distal end of the upwardly-extending slide member away from the track such that said member pivots over the track second side causing the slide into and firmly up against the track inclined first side until the slide is immovably secured in the track.

* * * * *